US011009198B2

(12) United States Patent
Weng

(10) Patent No.: US 11,009,198 B2
(45) Date of Patent: May 18, 2021

(54) WALL LAMP

(71) Applicant: Yunbing Weng, Taizhou (CN)

(72) Inventor: Yunbing Weng, Taizhou (CN)

( * ) Notice: Subject to any disclaimer, the term of this patent is extended or adjusted under 35 U.S.C. 154(b) by 0 days.

(21) Appl. No.: 16/558,087

(22) Filed: Aug. 31, 2019

(65) Prior Publication Data

US 2020/0309333 A1 Oct. 1, 2020

(51) Int. Cl.
*F21S 9/02* (2006.01)
*F21V 1/00* (2006.01)
*F21W 121/00* (2006.01)

(52) U.S. Cl.
CPC ..... *F21S 9/02* (2013.01); *F21V 1/00* (2013.01); *F21W 2121/00* (2013.01)

(58) Field of Classification Search
CPC ..... F21S 9/02; F21S 10/007; F21V 1/10; F21V 1/00
See application file for complete search history.

(56) References Cited

U.S. PATENT DOCUMENTS 8,104,928 B1 * 1/2012 Horn ..... F21V 21/30 362/287
2002/0181234 A1 * 12/2002 Kawahara ..... F21V 5/04 362/257
2009/0243495 A1 * 10/2009 Levine ..... F21S 9/02 315/153
2015/0276178 A1 * 10/2015 Chien ..... F21V 23/0442 362/95
2019/0353317 A1 * 11/2019 Chang ..... F21S 9/02

* cited by examiner

*Primary Examiner* — Evan P Dzierzynski
(74) *Attorney, Agent, or Firm* — Law Offices of Steven W. Weinrieb

(57) ABSTRACT

A wall lamp includes a lamp holder and a lamp cover. A lamp bulb is located in the lamp holder. The lamp cover is located on the lamp holder. A fixing plate is located on a bottom portion of the lamp cover. A pattern film defined in the lamp cover. A pattern is capable of being projected from the lamp cover when the lamp bulb is lighted. Patterns can be projected to the wall and can change follow the pattern film. The shape of the lamp cover can be simplified, instead of conventional complex shape.

10 Claims, 6 Drawing Sheets

WALL LAMP

FIELD OF THE INVENTION

The present disclosure relates to the field of illumination, and in particular, it relates to a lamp which can project patterns on the wall.

BACKGROUND OF THE INVENTION

Lamps are type of illumination, which can provide light in daily life. However, people is discontented with the lamp's ordinary use as demands change. Wall lamps with decorative function which can project decoration patterns on the wall come to our lives.

Conventional wall lamps are formed to different appearance, such as elk, or star. However, the configuration of these wall lamps are complex, and is difficult to manufacture and is hard to clean.

SUMMARY OF THE INVENTION

The technical problem to be solved by the present invention is to provide a wall lamp, which can project different patterns through different pattern films. The wall lamp is easy to be manufactured and is easy to clean.

In order to solve the above technical problem, one embodiment of the invention provides the following technical solution:

One embodiment of the invention provides a wall lamp. A wall lamp includes a lamp holder and a lamp cover. A lamp bulb is located in the lamp holder. The lamp cover is located on the lamp holder. A fixing plate is located on a bottom portion of the lamp cover. A pattern film defined in the lamp cover. A pattern is capable of being projected from the lamp cover when the lamp bulb is lighted.

As a preferred technical solution of the embodiment of the invention, the pattern film is trapezoid, triangle, or stripe-shaped.

As a preferred technical solution of the embodiment of the invention, an engaging portion is recessed in the fixing plate to receive a peg, and a blocking portion is located on one side of the engaging portion to hold the peg.

As a preferred technical solution of the embodiment of the invention, a switch is located on an outer side of the lamp holder to control the lamp blub.

As a preferred technical solution of the embodiment of the invention, three battery boxes are located in the lamp holder. A battery slot is defined in each battery box. Each battery box extends along longitude. The three battery boxes are arranged in triangle. A control board is located on a central position of the three battery boxes. The lamp bulb is located on the control board.

As a preferred technical solution of the embodiment of the invention, a spacing plate is located on the control board. A protrusion is formed on a lateral edge of the spacing plate. A recess is defined in one of the three battery boxes corresponding to the protrusion. The control board and the spacing plate are mounted to the lamp holder through screws.

As a preferred technical solution of the embodiment of the invention, a plurality of bumps is formed on an outer edge of the lamp holder to increase an engaging force and friction.

As a preferred technical solution of the embodiment of the invention, a locking portion is formed on the lamp cover. A locking slot is defined in the fixing plate corresponding to the locking portion. The fixing plate is mounted to the lamp cover.

In the embodiment above, the wall lamp defines the pattern film in the lamp cover. Patterns can be projected to the wall and can change follow the pattern film. The shape of the lamp cover can be simplified, instead of conventional complex shape. The lamp cover is easy to be manufactured and easy to clean in this way.

BRIEF DESCRIPTION OF THE DRAWINGS

The drawings are used for providing further understanding of the present invention, constitute a part of the description and are used for explaining the present invention together with the embodiment of the present invention, but do not constitute a limitation to the present invention. In the drawings.

DETAILED DESCRIPTION OF THE ILLUSTRATED EMBODIMENTS

Figure 1:
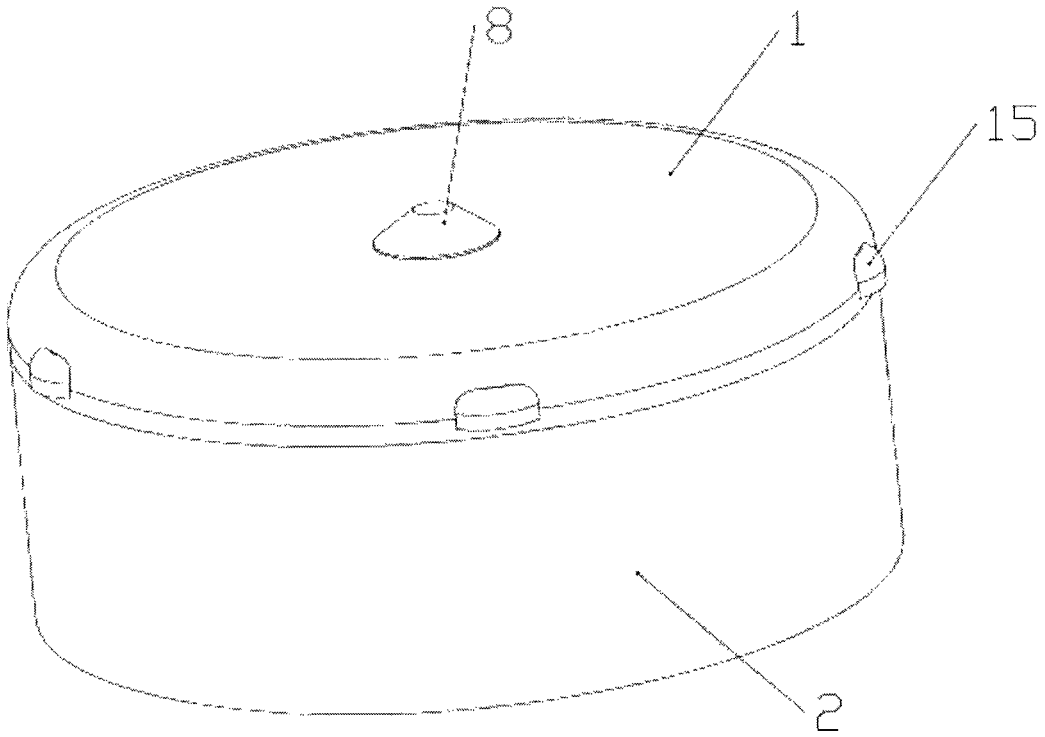
FIG. 1 is a schematic view of one embodiment of a wall lamp.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

Figure 2:
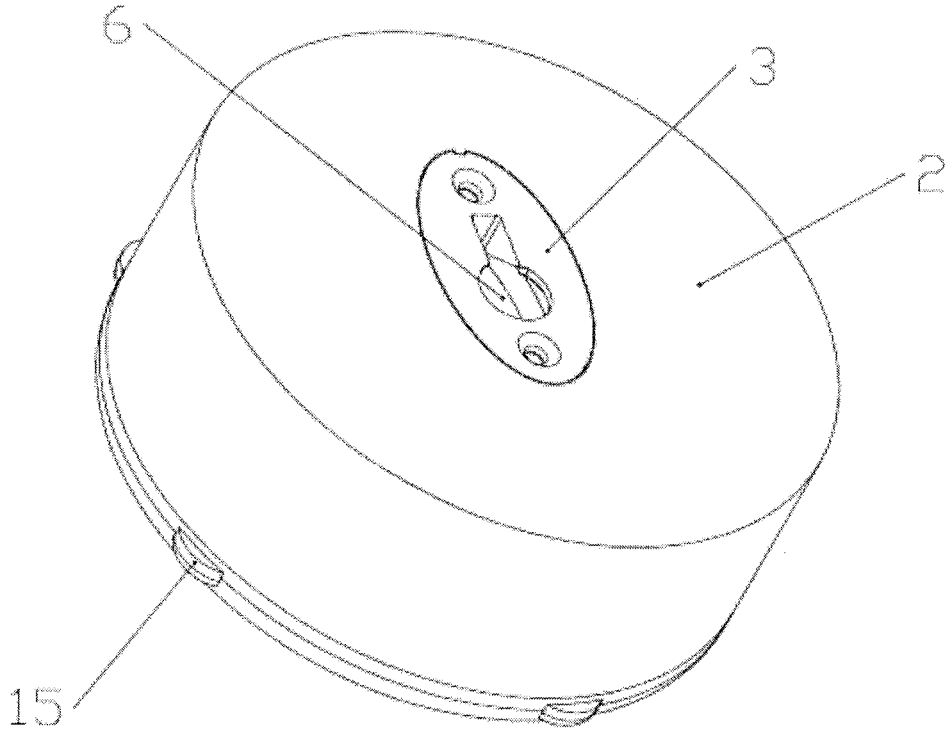
FIG. 2 is a schematic view of the embodiment of the wall lamp of FIG. 1, but shown from another aspect.
Figure 3:
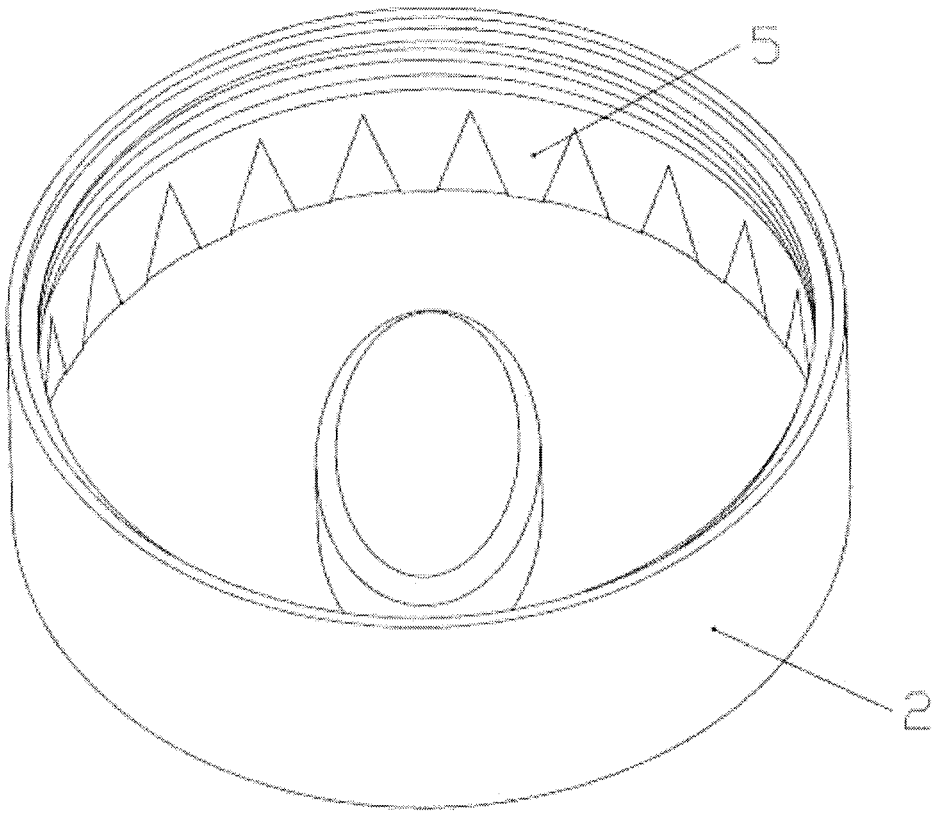
FIG. 3 is a schematic view of one embodiment of a lamp cover of the wall lamp of FIG. 1.

As shown in FIG. 1, FIG. 2, and FIG. 3, in one embodiment, a wall lamp includes a lamp holder 1 and a lamp cover 2. The lamp cover 2 is located on the lamp holder 1. The lamp cover 2 can include transparent material. A lamp bulb 4 located in the lamp holder 1 can light external environment through the lamp cover 2.

A fixing plate 3 is located on a bottom portion of the lamp cover 2. The lamp cover 2 is mounted to a wall through the fixing plate 3. An engaging portion 6 is recessed in the fixing plate 3 to receive a peg. A blocking portion 7 is located on one side of the engaging portion 6 to hold the peg on the wall. When in use, the peg can extend within the engaging portion 6 and is blocked by the blocking portion 7. In this way, the lamp cover 2 can be mounted on the wall stably. The engaging portion 6 and the blocking portion 7 are easy to be manufactured. The blocking portion 7 can block and restrict the movement of the peg. The lamp cover 2 cannot easily loose or drop due to shake.

In other embodiments, the fixing plate 3 can be replaced by a hole. The peg can extend into the hole to secure the lamp cover 2 to the wall. The fixing plate 3 can also be a sticker. The lamp cover 2 can directly pasted on the wall by the sticker. The fixing plate 3 is used to secure the lamp cover 2 to the wall.

Figure 4:
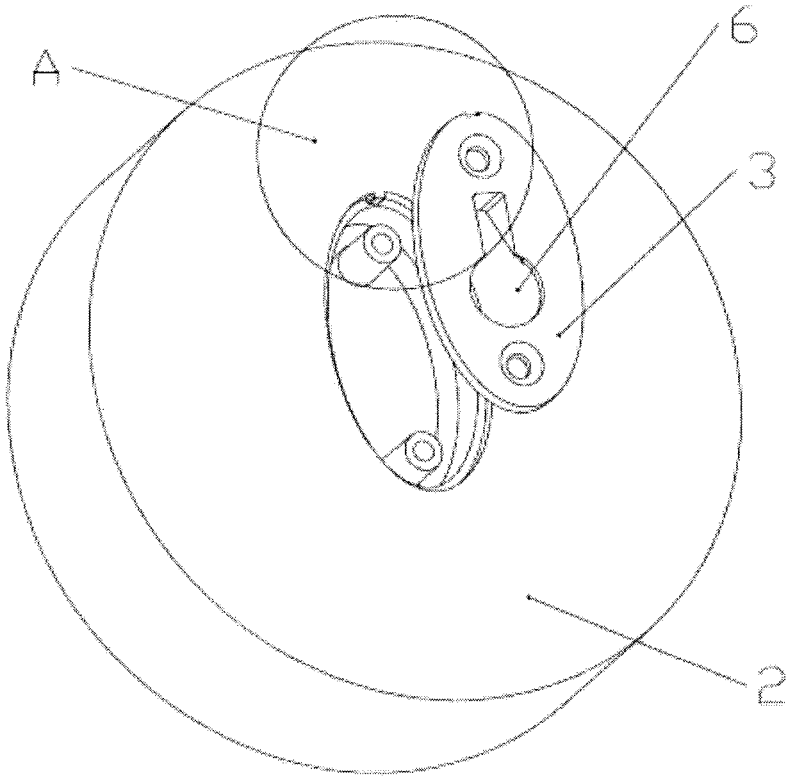
FIG. 4 is a schematic view of the embodiment of the lamp cover of FIG. 3, but shown from another aspect.
Figure 5:
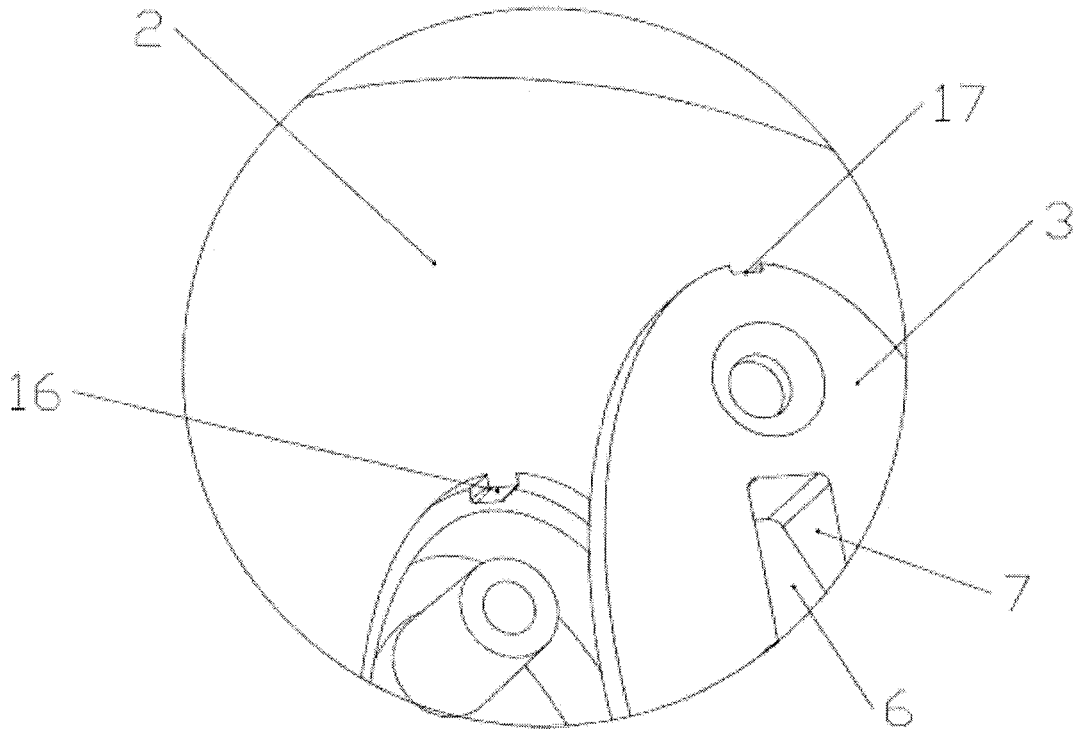
FIG. 5 is an enlarged view of circled portion A of FIG. 4.

As shown in FIG. 4 and FIG. 5, in one embodiment, the fixing plate 3 can be detachably secured to the lamp cover 2. A locking portion 16 is formed on the lamp cover 2. A locking slot 17 is defined in the fixing plate 3 corresponding to the locking portion 16. When in use, the locking portion 16 is engaged with the locking slot 17. The fixing plate 3 is screwed to the lamp cover 2. The fixing plate 3 is mounted to the lamp cover 2 in a simple way.

The lamp bulb 4 is located in the lamp holder 1. A pattern film 5 is defined in the lamp cover 4. The lamp bulb 4 can project light through the pattern film 5 to the wall. The projected pattern can be changed due to variation of the pattern film 5. The shape of the lamp cover 2 can be simplified, instead of conventional complex shape. The lamp cover 2 can be easily manufactured and is easy to be cleaned in this way.

The pattern film 5 can be trapezoid, triangle, or stripe-shaped. The projected pattern can be different due to variation of the pattern film 5.

Figure 6:
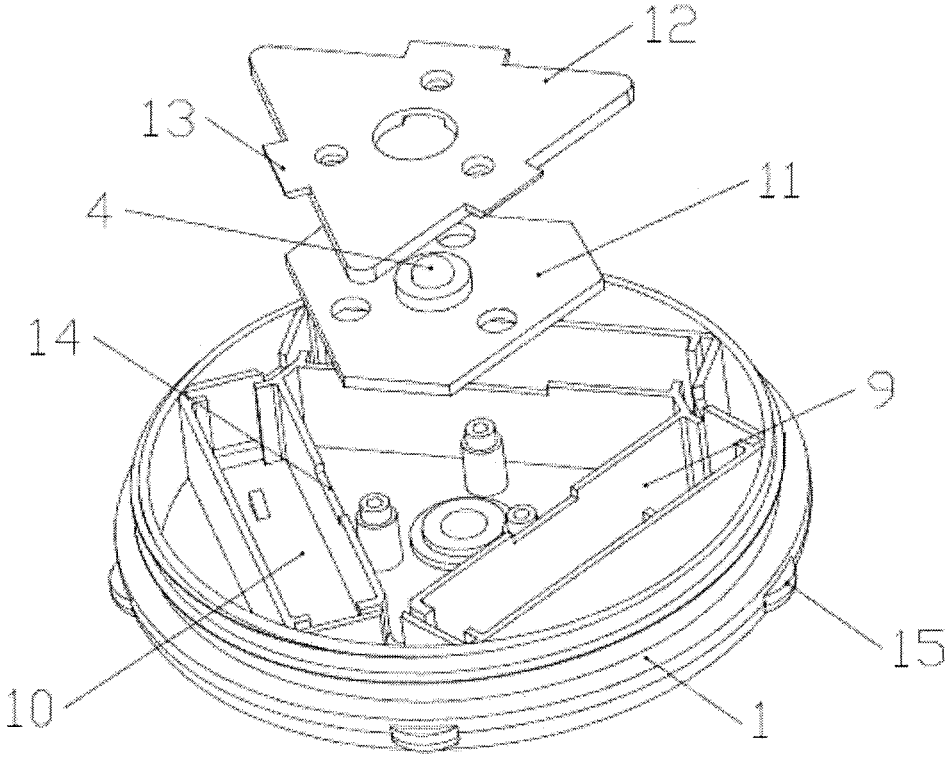
FIG. 6 is a schematic view of the embodiment of the lamp holder of the wall lamp.

As shown in FIG. 6, three battery boxes 9 are located in the lamp holder 1 for receiving batteries. A battery slot 10 is defined in each battery box 9. Each battery box 9 extends along longitude direction. The three battery boxes 9 are arranged in triangle. The arrangement of the three battery boxes 9 can save space within the lamp holder 1.

A control board 11 is located on a central position of the three battery boxes 9. The bulb is located on the control board 11. Referring to FIG. 1, a switch 8 is located on an outer side of the lamp holder 1 for controlling the lamp blub 4.

When in use, the batteries can provide power to the lamp bulb 4. The switch 8 can control the lamp bulb 4. The control board 11 can adjust other functions of the lamp bulb 4, such as light color or light intensity.

As shown in FIG. 6, a spacing plate 12 is located on the control board 11. A protrusion 13 is formed on each lateral edge of the spacing plate 12. A recess 14 is defined in each battery box 12 corresponding to the protrusion 13. The control board 11 and the spacing plate 12 can be mounted to the lamp holder 1 through screws. When in use, the wall lamp is hang on the wall. The batteries may tilt due to the gravity. The spacing plate 12 can restrict the movement of the position of the three battery boxes 9 to prevent the batteries from dropping. The spacing plate 12 is located on one side of the control panel 11 to prevent the control panel 11 from removing from the lamp holder 1.

Referring to FIG. 1, FIG. 2 and FIG. 3, the lamp holder 1 and the lamp cover 2 are mounted through screws. In other embodiments, the lamp holder 1 and the lamp cover 2 can be mounted through buckle connection. A plurality of bumps 15 is formed on an outer edge of the lamp holder 1 to increase an engaging force and friction.

In the embodiment above, the wall lamp defines the pattern film in the lamp cover. Patterns can be projected to the wall and can change follow the pattern film. The shape of the lamp cover can be simplified, instead of conventional complex shape. The lamp cover is easy to be manufactured and easy to clean in this way.

The embodiments shown and described above are only examples. Many details are often found in the art such as the other features of a system for generating picture thumbnail. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A lamp, comprising:

a lamp holder;

a lamp bulb located within and mounted upon a control board disposed within said lamp holder for controlling functions of said lamp bulb;

a lamp cover located upon said lamp holder and having a pattern film disposed thereon which is adapted to be illuminated by said lamp bulb and projected from said lamp cover when said lamp bulb is illuminated;

three battery boxes disposed within said lamp holder, arranged within a triangular pattern, having a battery respectively electrically connected to said lamp bulb for providing electrical power to said lamp bulb, and having a recess respectively defined within an upper side wall portion; and a spacing plate having a triangular configuration, fixedly secured to said lamp holder, and having a protrusion upon each side of said triangular configuration for respectively engaging said recesses respectively defined within said upper side wall portions of said three battery boxes for retaining said control board and said battery boxes within said lamp holder.

2. The lamp of claim 1, wherein the pattern film has patterns disposed thereon which are selected from the group comprising a trapezoid, triangle, and stripes.

3. The lamp of claim 1, wherein:

a switch is located upon an outer surface of said lamp holder so as to control the illumination of said lamp blub.

4. The lamp of claim 1, wherein:

said at least one battery box comprises three battery boxes.

5. The lamp of claim 4, wherein:

a battery slot is defined within each one of said three battery boxes for housing a battery.

6. The lamp as set forth in claim 4, wherein:

said three battery boxes are arranged within a triangular array so as to surround said control board.

7. The lamp of claim 1, wherein:

a plurality of bumps are formed upon an outer peripheral edge portion of said lamp holder so as to increase engagement and frictional forces.

8. The lamp of claim 1, further comprising:

a fixing plate located upon a bottom portion of said lamp cover.

9. The lamp of claim 8, wherein:

an engaging portion is recessed within said fixing plate for receiving a peg in order to permit said lamp to be mounted upon a wall; and a blocking portion is located upon one side of said engaging portion so as to hold said peg within said engaging portion.

10. The lamp of claim 1, wherein:

said control board and said spacing plate are fixedly secured to said lamp holder by screw fasteners.

* * * * *